US011959715B1

(12) United States Patent
Noonan et al.

(10) Patent No.: US 11,959,715 B1
(45) Date of Patent: Apr. 16, 2024

(54) FIREARM AND A METHOD OF MANUFACTURING IT

(71) Applicant: F.M. Products Inc, Boise, ID (US)

(72) Inventors: Paul T. Noonan, Boise, ID (US); Aaron Neal Trout, Boise, ID (US)

(73) Assignee: F.M. Products Inc, Boise, ID (US)

( * ) Notice: Subject to any disclaimer, the term of this patent is extended or adjusted under 35 U.S.C. 154(b) by 49 days.

(21) Appl. No.: 17/515,427

(22) Filed: Oct. 30, 2021

Related U.S. Application Data

(60) Provisional application No. 63/108,313, filed on Oct. 31, 2020, provisional application No. 63/108,309, filed on Oct. 31, 2020.

(51) Int. Cl.
*F41A 3/26* (2006.01)
*F41A 19/10* (2006.01)

(52) U.S. Cl.
CPC ..... *F41A 3/26* (2013.01); *F41A 19/10* (2013.01)

(58) Field of Classification Search
CPC ..... F41A 3/12; F41A 3/14; F41A 3/26
See application file for complete search history.

(56) References Cited

U.S. PATENT DOCUMENTS

| | | | | |
|---|---|---|---|---|
| 11,703,297 | B2 * | 7/2023 | Seigler | F41G 3/26 434/16 |
| 2013/0125440 | A1 * | 5/2013 | Zheng | F41A 15/14 42/14 |
| 2014/0041518 | A1 * | 2/2014 | Neitzling | F41A 3/26 89/191.01 |
| 2021/0003357 | A1 * | 1/2021 | Durham, III | F41A 3/70 |
| 2021/0381784 | A1 * | 12/2021 | Alomaira | F41A 3/22 |

* cited by examiner

*Primary Examiner* — J. Woodrow Eldred

(57) ABSTRACT

A bolt carrier group and a method for manufacturing it are disclosed. The bolt carrier group contains a first bolt carrier section containing a first end and a second end, a second bolt carrier section containing a first end and a second end, a plurality of pins positioned between the first bolt carrier section and the second bolt carrier section, a coupling pin configured to prevent decoupling of the first bolt carrier section from the second bolt carrier section.

4 Claims, 21 Drawing Sheets

FIREARM AND A METHOD OF MANUFACTURING IT

CROSS REFERENCE TO RELATED APPLICATIONS

This application claims the benefit of U.S. Provisional Application No. 63/108,309, filed on Oct. 31, 2020, which is incorporated herein by reference in its entirety. This application claims the benefit of U.S. Provisional Application No. 63/108,313, filed on Oct. 31, 2020, which is incorporated herein by reference in its entirety.

FIELD

The present invention relates to firearm manufacture. More particularly, the present invention relates to a firearm and a method of manufacturing it.

BACKGROUND

The AR15/M16 family of firearms and their derivatives, have a bolt carrier which typically includes a bolt mounted in the carrier for axial sliding movement and rotation, a firing pin slidably mounted within the bolt and bolt carrier for restricted reciprocating axial movement, and a cam pin for limiting relative rotation between the bolt and the bolt carrier.

The bolt carrier is generally cylindrical in shape with a longitudinally extending circular bore throughout its length. An elongated opening is provided in the top and bottom of the carrier to allow the hammer to extend into the interior of the bolt carrier and strike the firing pin. The carrier is received and housed within the firearms receiver with the front of the carrier housing the bolt. The bolt carrier group is responsible for stripping, chambering, locking, firing, extraction and ejection of ammunition cartridges for the host rifle.

The prior art bolt carriers are expensive to manufacture and hard to assemble. Therefore, a need exists for a better type of bolt carrier group for firearms.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
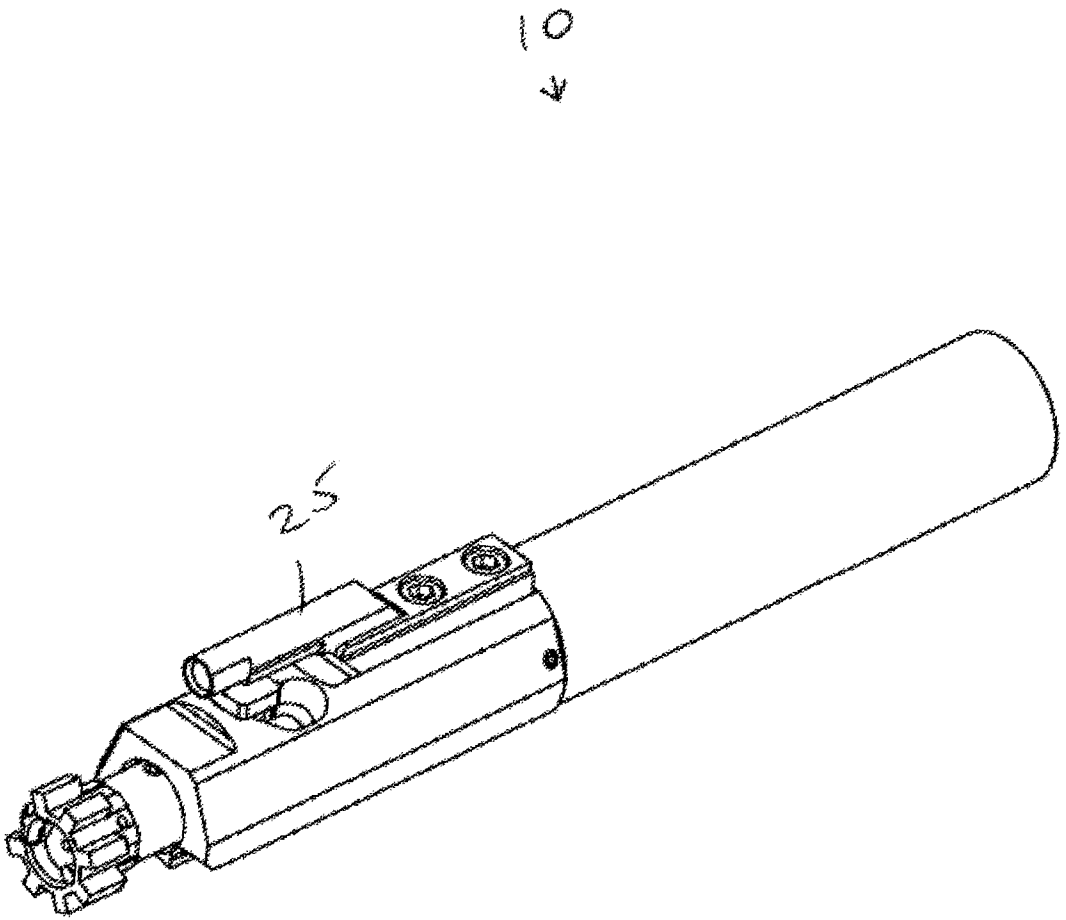
FIG. 1 depicts a bolt carrier group according to some embodiments presently disclosed.
Figure 2:
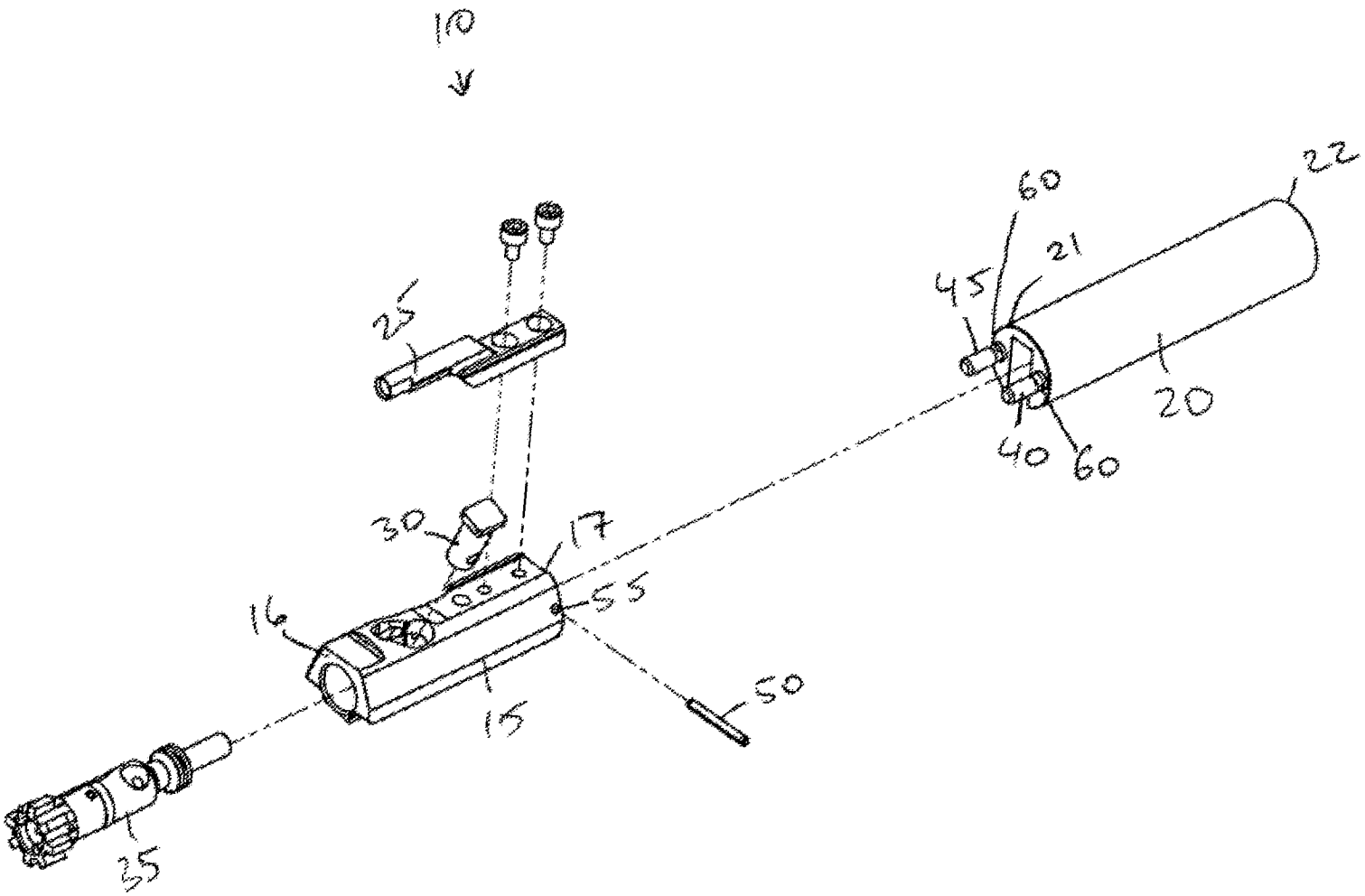
FIG. 2 depicts an exploded view of a bolt carrier group according to some embodiments presently disclosed.
Figure 3:
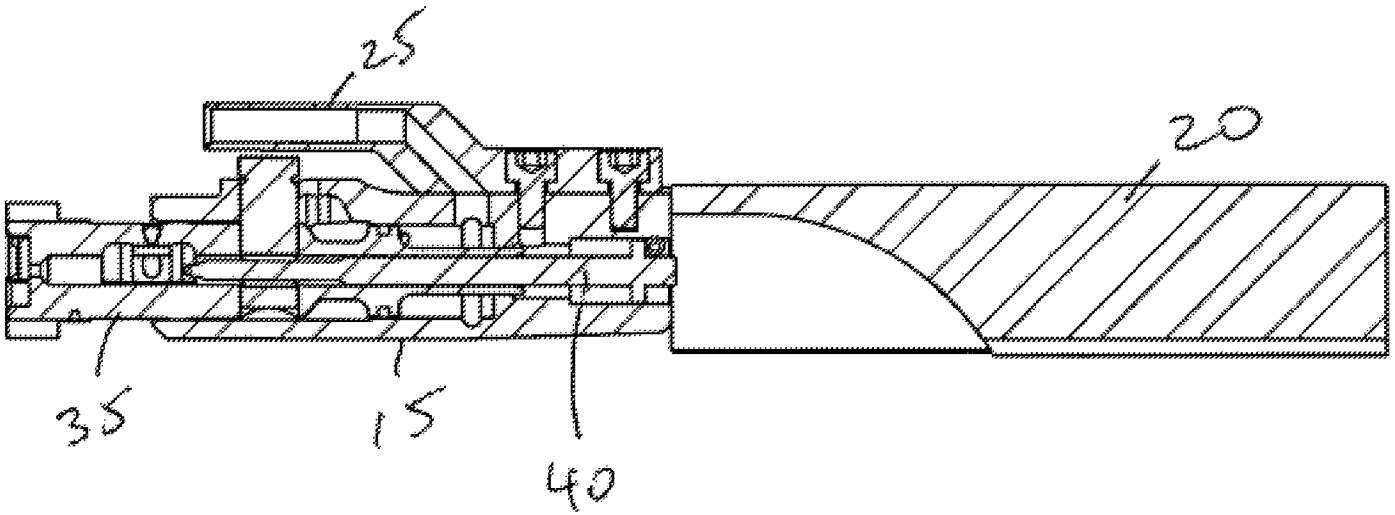
FIG. 3 depicts a cut away view of a bolt carrier group according to some embodiments presently disclosed.

Referring to FIG. 1, an assembled view of a bolt carrier group 10 is shown according to some embodiments presently disclosed. Referring to FIG. 2, an exploded view of the bolt carrier group 10 is shown according to some embodiments presently disclosed. Referring to FIG. 3, a cut away view of the bolt carrier group 10 is shown according to some embodiments presently disclosed.

The bolt carrier group 10 may comprise bolt carrier sections 15 and 20, a carrier key 25, a rotate cam pin 30, a pull bolt 35, a firing pin 40, and/or a retaining pin (not shown).

According to some embodiments presently disclosed, the bolt carrier sections 15 and 20 may be coupled together to form a complete bolt carrier. According to some embodiments presently disclosed, the bolt carrier section 20 comprises a first end 21 and a second end 22. According to some embodiments presently disclosed, the bolt carrier section 20 comprises one or more pins 40, 45 protruding from the first end 21. According to some embodiments, the one or more pins 40, 45 are removably coupled with the first end 21.

According to some embodiments presently disclosed, the bolt carrier section 15 comprises a first end 16 and a second end 17. According to some embodiments presently disclosed, the bolt carrier section 17 comprises one or more apertures configured to accommodate the pins 40, 45.

According to some embodiments presently disclosed, a coupling pin 50 is positioned for coupling the second end 17 of the bolt carrier section 15 with the first end 21 of the bolt carrier section 20 by inserting the pin 50 though an aperture 55 located in the bolt carrier section 15 and engaging it with notches 60 in the one or more pins 40, 45 (shown in FIG. 2). According to some embodiments presently disclosed, the coupling pin 50 prevents the bolt carrier section 20 from decoupling from the bolt carrier section 15.

According to some embodiments, the bolt carrier group 10 is used on AR type of rifles with direct impingement.

Figure 4:
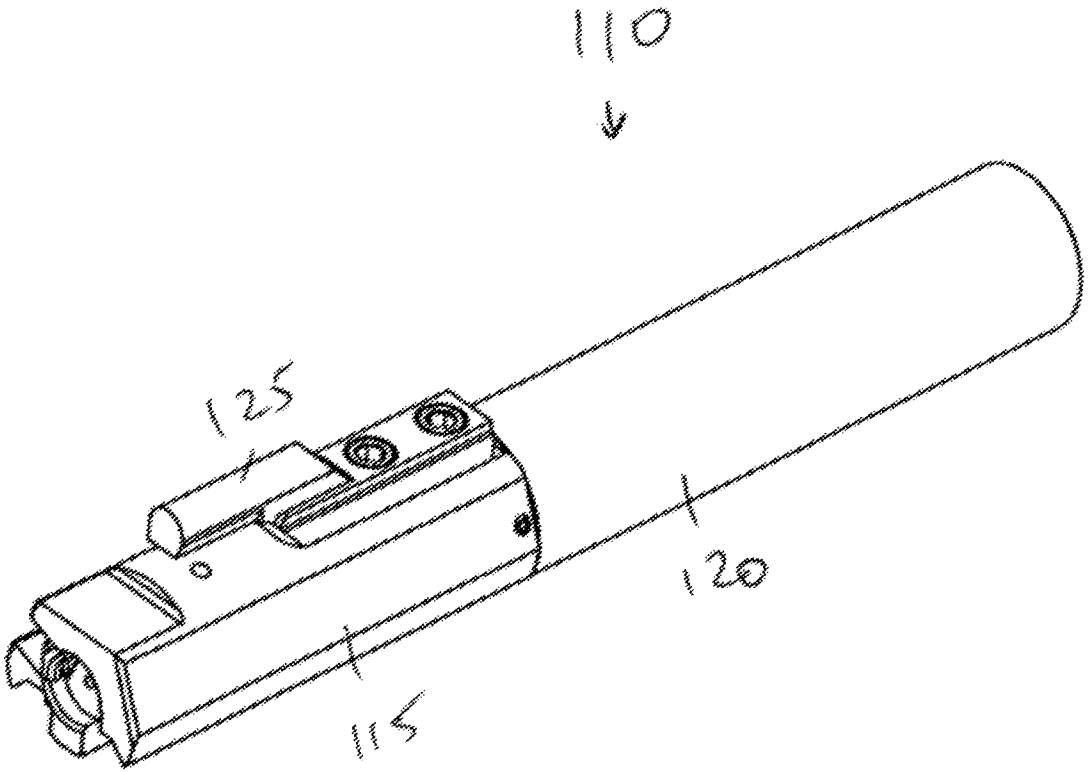
FIG. 4 depicts a bolt carrier group according to some embodiments presently disclosed.
Figure 5:
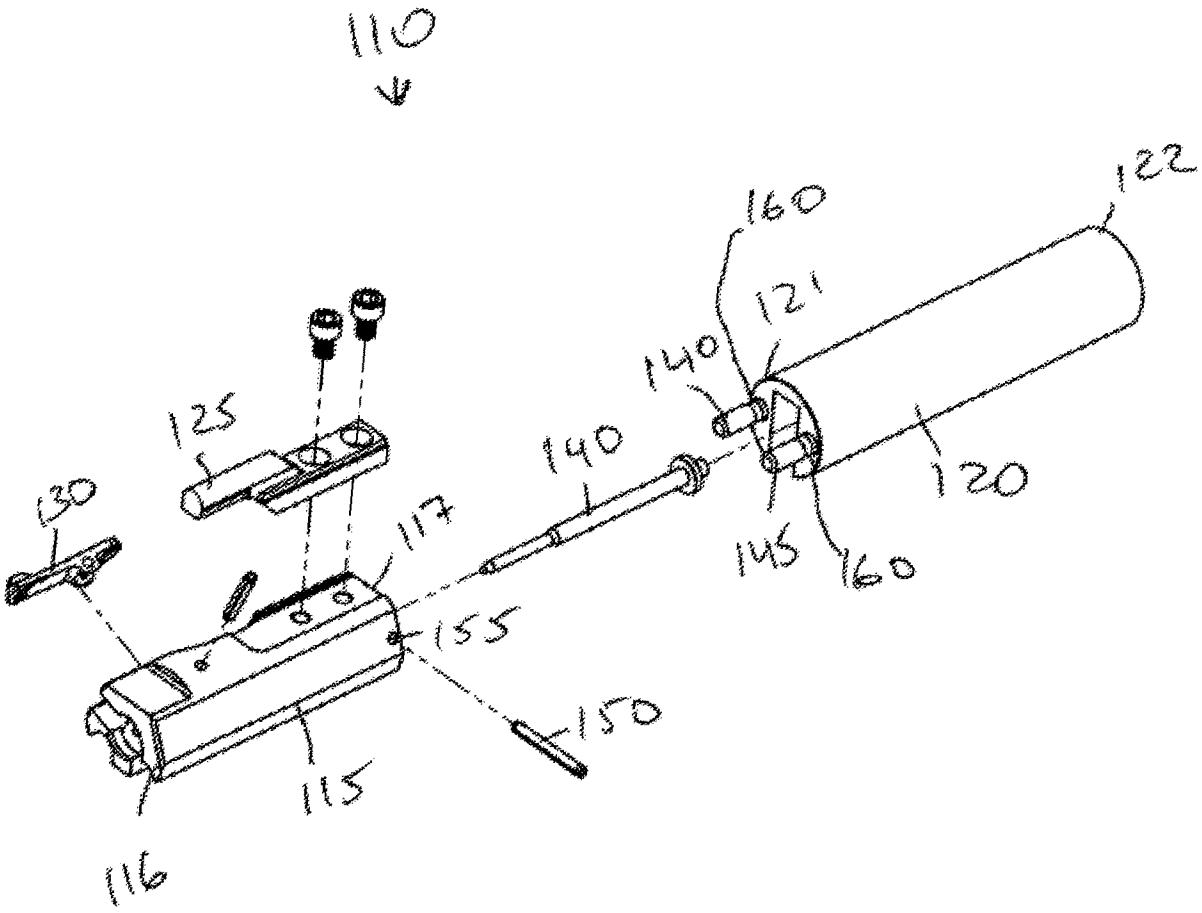
FIG. 5 depicts an exploded view of a bolt carrier group according to some embodiments presently disclosed.
Figure 6:
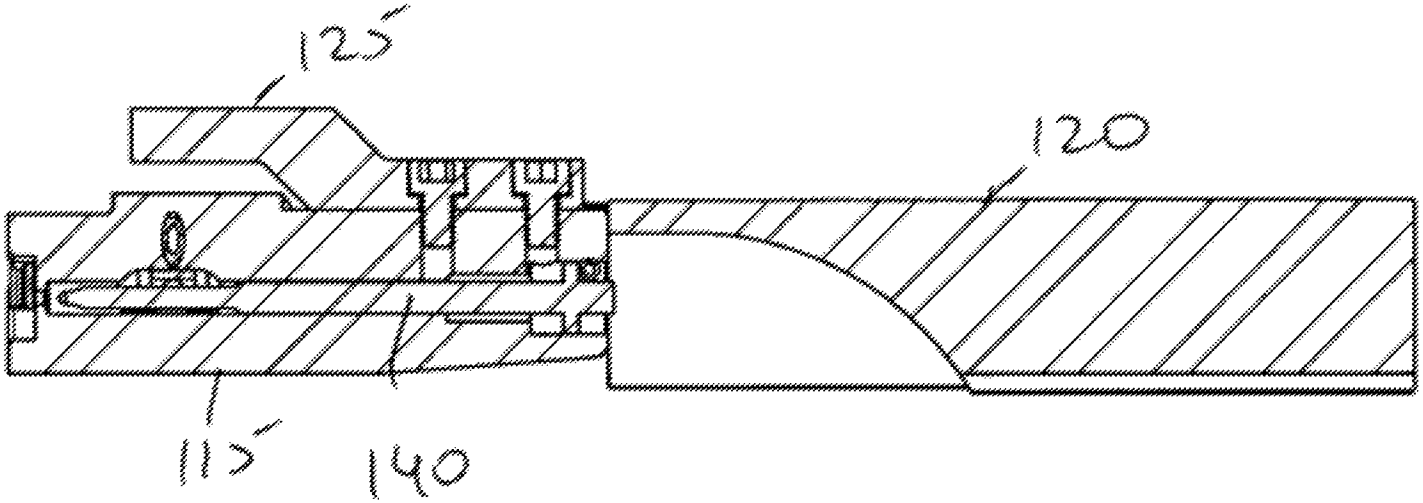
FIG. 6 depicts a cut away view of a bolt carrier group according to some embodiments presently disclosed.
Figure 7:
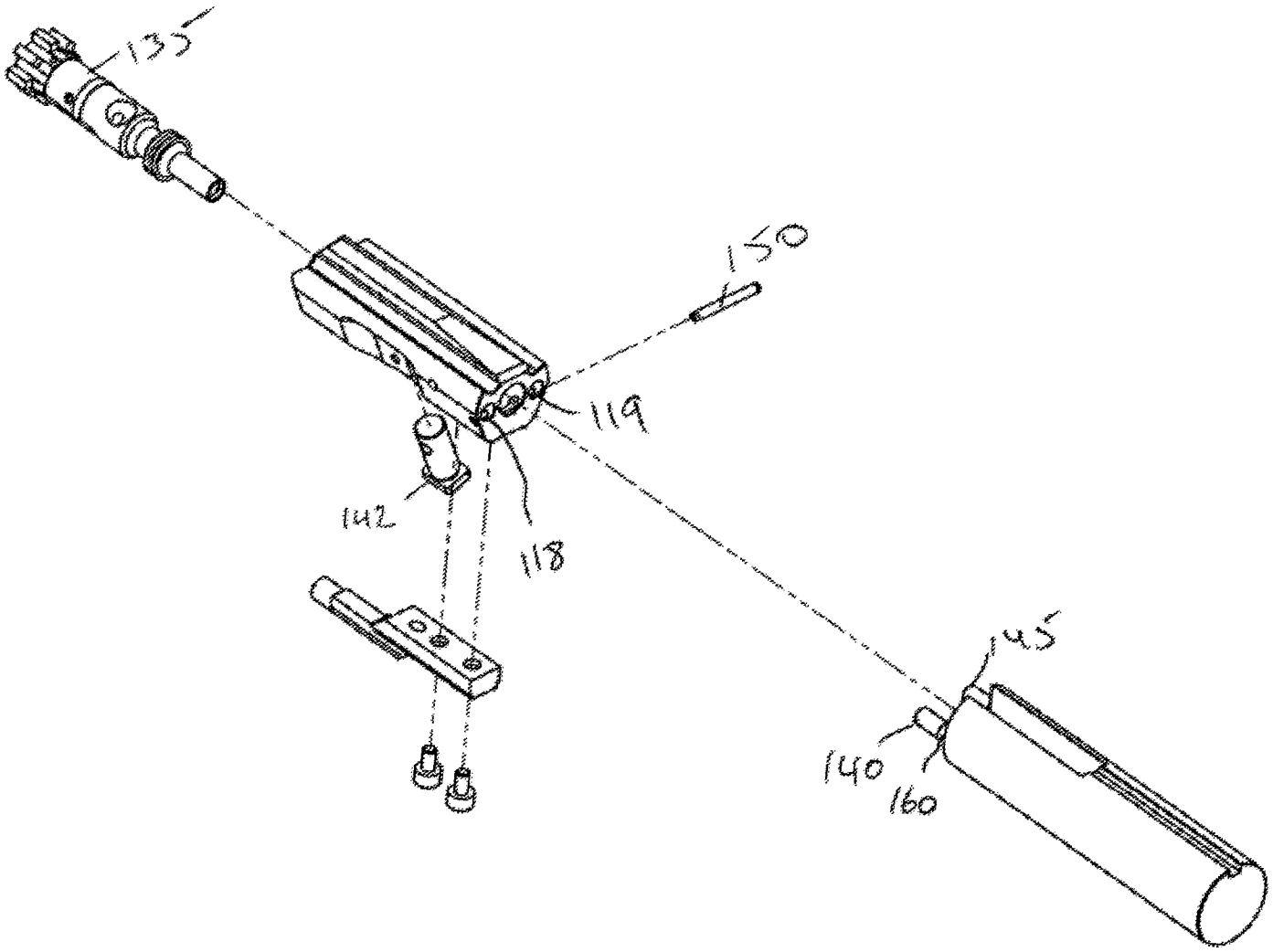
FIG. 7 depicts an exploded view of a bolt carrier group according to some embodiments presently disclosed.

Referring to FIG. 4, an assembled view of a bolt carrier group 110 is shown according to some embodiments presently disclosed. Referring to FIGS. 5 and 7, an exploded view of the bolt carrier group 110 is shown according to some embodiments presently disclosed. Referring to FIG. 6, a cut away view of the bolt carrier group 110 is shown according to some embodiments presently disclosed.

The bolt carrier group 110 may comprise bolt carrier sections 115 and 120, a carrier key 125, an extractor 130, a bolt 135, a firing pin 140, and/or a bolt cam pin 142.

According to some embodiments presently disclosed, the bolt carrier sections 115 and 120 may be coupled together to form a complete bolt carrier. According to some embodiments presently disclosed, the bolt carrier section 120 comprises a first end 121 and a second end 122. According to some embodiments presently disclosed, the bolt carrier section 120 comprises one or more pins 140, 145 protruding from the first end 121. According to some embodiments, the one or more pins 140, 145 are removably coupled with the first end 121.

According to some embodiments presently disclosed, the bolt carrier section 115 comprises a first end 116 and a second end 117. According to some embodiments presently disclosed, the bolt carrier section 117 comprises one or more apertures 118, 119 (shown in FIG. 7) configured to accommodate the pins 140, 145.

According to some embodiments presently disclosed, a coupling pin 150 is positioned for coupling the second end 117 of the bolt carrier section 115 with the first end 121 of the bolt carrier section 120 by inserting the pin 150 though an aperture 155 located in the bolt carrier section 115 and engaging it with notches 160 in the one or more pins 140, 145. According to some embodiments presently disclosed, the coupling pin 150 prevents the bolt carrier section 120 from decoupling from the bolt carrier section 115.

According to some embodiments, the bolt carrier group 110 is used on AR type of rifles with blowback.

Referring now to FIGS. 8-13 and 20-21, there is shown a firearm 510 according to some of the embodiment of the present disclosure. FIGS. 8-13 illustrate a complete firearm that includes a frame 520, a barrel 521, and a buttstock 523.

The frame 520 can have a forward end 524 and a rear end 525 opposite the forward end 524. The frame 520 can include an operational magazine well 550. The magazine well 550 can be adapted to receive and hold a magazine.

The operational magazine well 550 can have an upper end that is open, allowing a projectile in the operational magazine 554 to be transferred to a firing assembly and fired from the firearm 510. Put another way, the operational magazine can be in communication with a passage within the firearm in which a bolt reciprocates to feed cartridges from the magazine into a well at the breech end of the barrel 521.

The frame 520 can further include a trigger 522 operable to initiate firing of a projectile from the firearm 510. The trigger 522 can be disposed between the operational magazine well 550 and a grip 560. For example, the operational magazine well 50 can be disposed forward of the trigger 522 and closer to the forward end 524 of the frame 520 than the grip 560. The grip 560 can be disposed behind the trigger 522 and closer to the rear end of the frame 520 than the operational magazine well 550.

According to some embodiments presently disclosed, the firearm 510 can have an operational magazine release 558 (shown in FIG. 12) operable to release an operational magazine 554 from the operational magazine well 550. The operational magazine release 558 can be disposed closer to the forward end 524 of the frame 520 than the trigger 522. The operational magazine release 558 can be adapted to be operable with a user's index or trigger finger of the "firing" hand when griping the firearm in a firing position as shown in FIG. 13.

Figure 10:
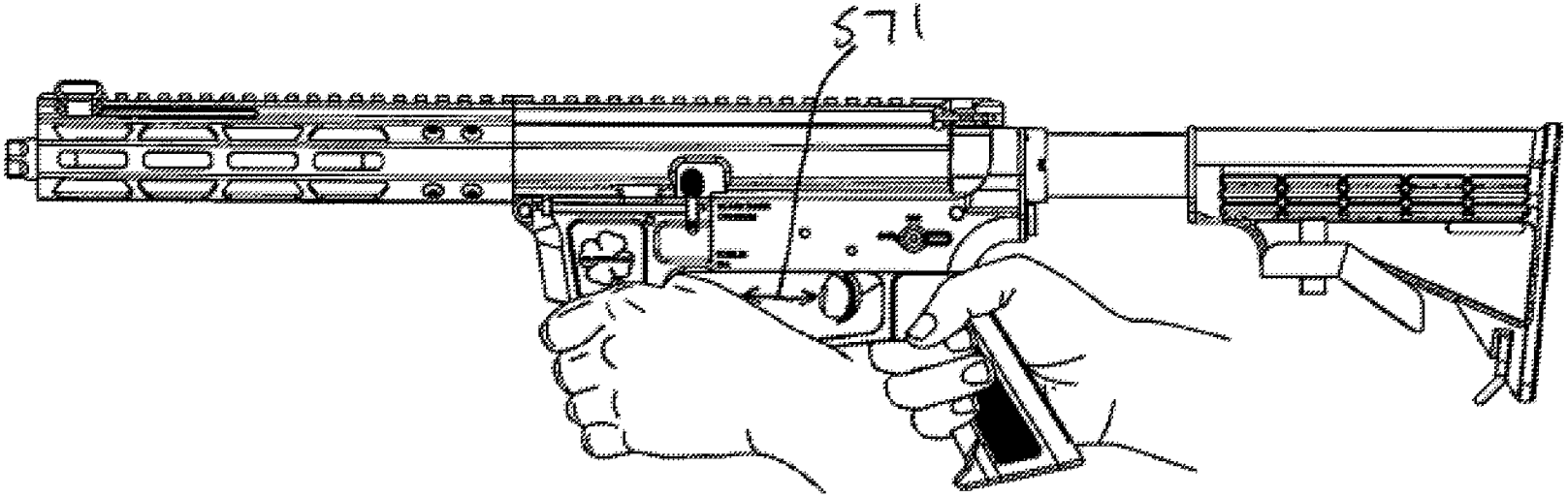

Another aspect of the present disclosure is a method for holding a firearm. Referring to FIGS. 10-13, the firearm 510 is illustrated being held by a user. As illustrated in FIGS. 10 and 12, a thumb of the left hand is positioned thought the trigger guard 561 to be able to grab and hold the operational magazine well 550 while the right hand is positioned to grab and hold the grip 560 and the index finger of the right hand is positioned on the trigger 522 ready to fire. It is to be understood that the firearm 510 can be held where a thumb of the right hand is positioned thought the trigger guard 561 to be able to grab and hold the operational magazine well 550 while the left hand is positioned to grab and hold the grip 560 and the index finger of the left hand is positioned on the trigger 522 ready to fire.

Figure 11:
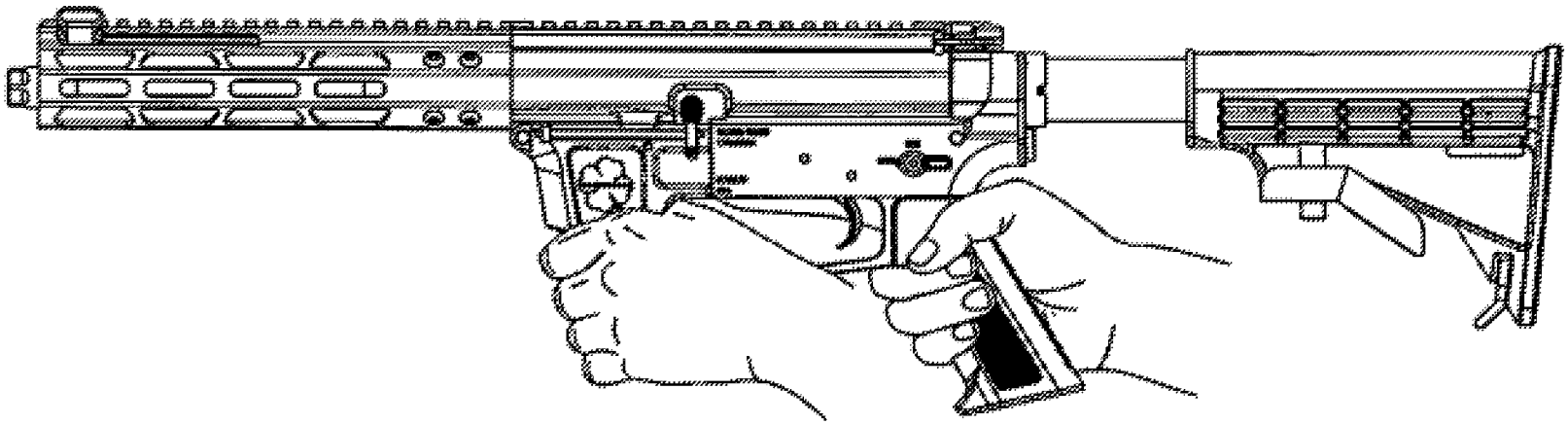
Figure 12:
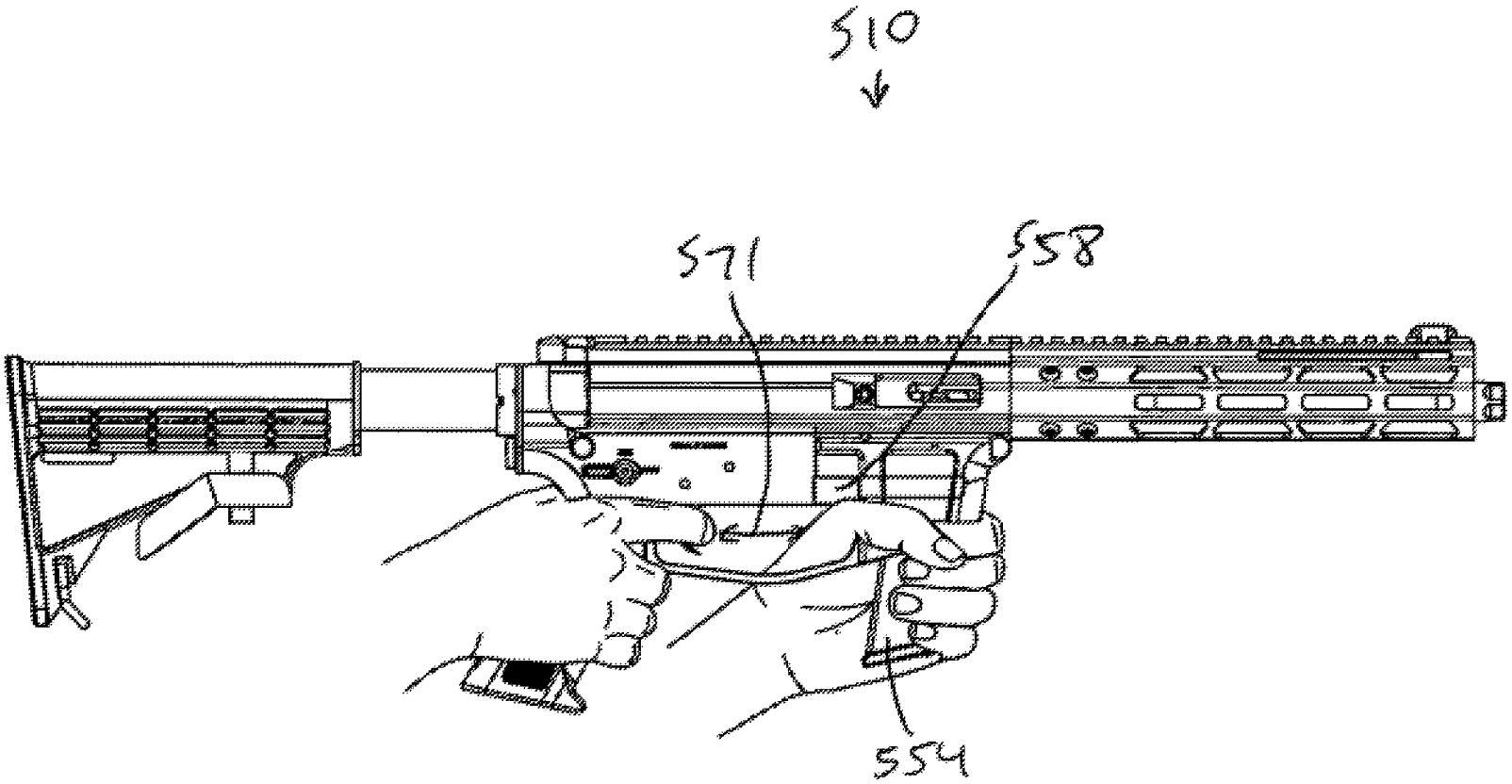
Figure 13:
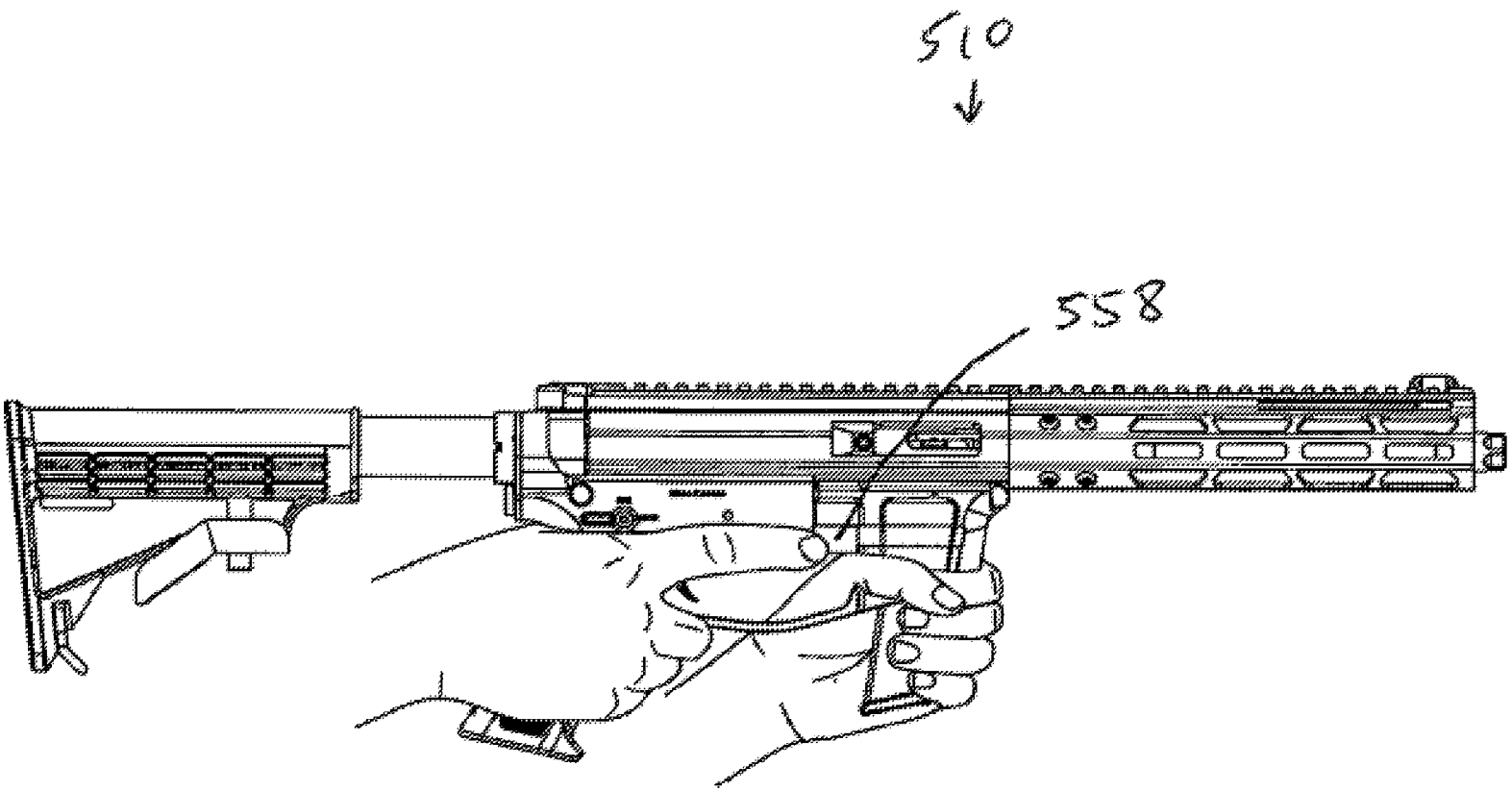

As illustrated in FIGS. 11 and 13, a thumb of the left hand is positioned thought the trigger guard 561 to be able to grab and hold the operational magazine well 550 while the right hand is positioned to grab and hold the grip 560 and the index finger of the right hand is positioned on the release 558 and ready to release the magazine 554.

According to some embodiments, as illustrated in FIGS. 10 and 12, a thumb of the non-firing hand is positioned thought the trigger guard 561 to be able to grab and hold the operational magazine well 550 while the firing hand is positioned to grab and hold the grip 560 and the index finger of the firing hand is positioned on the trigger 522 ready to fire. As illustrated in FIGS. 11 and 13, a thumb of the non-firing hand is positioned thought the trigger guard 561 to be able to grab and hold the operational magazine well 550 while the firing hand is positioned to grab and hold the grip 560 and the index finger of the firing hand is positioned on the release 558 and ready to release the magazine 554.

In this way, the user can have a firm hold on the frame 520 of the firearm 510 without having to reach and hold the handguard 573. This is particularly advantageous when the firearm 510 has a very short barrel 521 with little room to be able to hold it with a non-firing hand.

According to some embodiments, there is a first distance 571 within the trigger guard 561 between the firing hand and the non-firing hand. According to some embodiments, there is a first distance 571 within the trigger guard 561 between the trigger finger of the firing hand and the non-firing hand as shown in FIG. 10. According to some embodiments, there is a first distance 571 within the trigger guard 561 between the trigger finger positioned on the trigger 522 and the non-firing hand as shown in FIG. 10. According to some embodiments, the first distance 571 is about 1 inch. According to some embodiments, the first distance 571 is over 1 inch.

Figure 8:
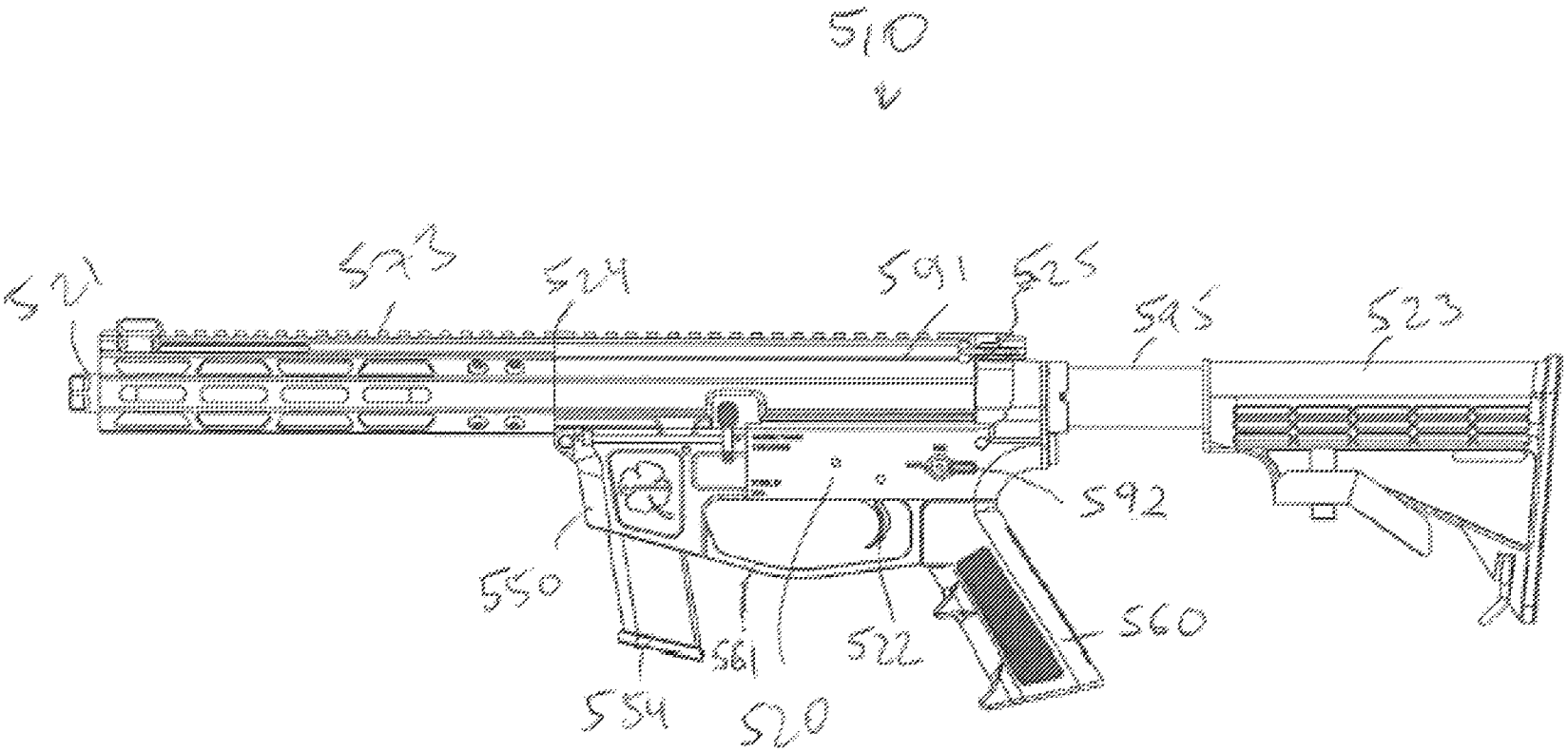
FIGS. 8-13 depict a firearm according to some embodiments presently disclosed.
Figure 9:
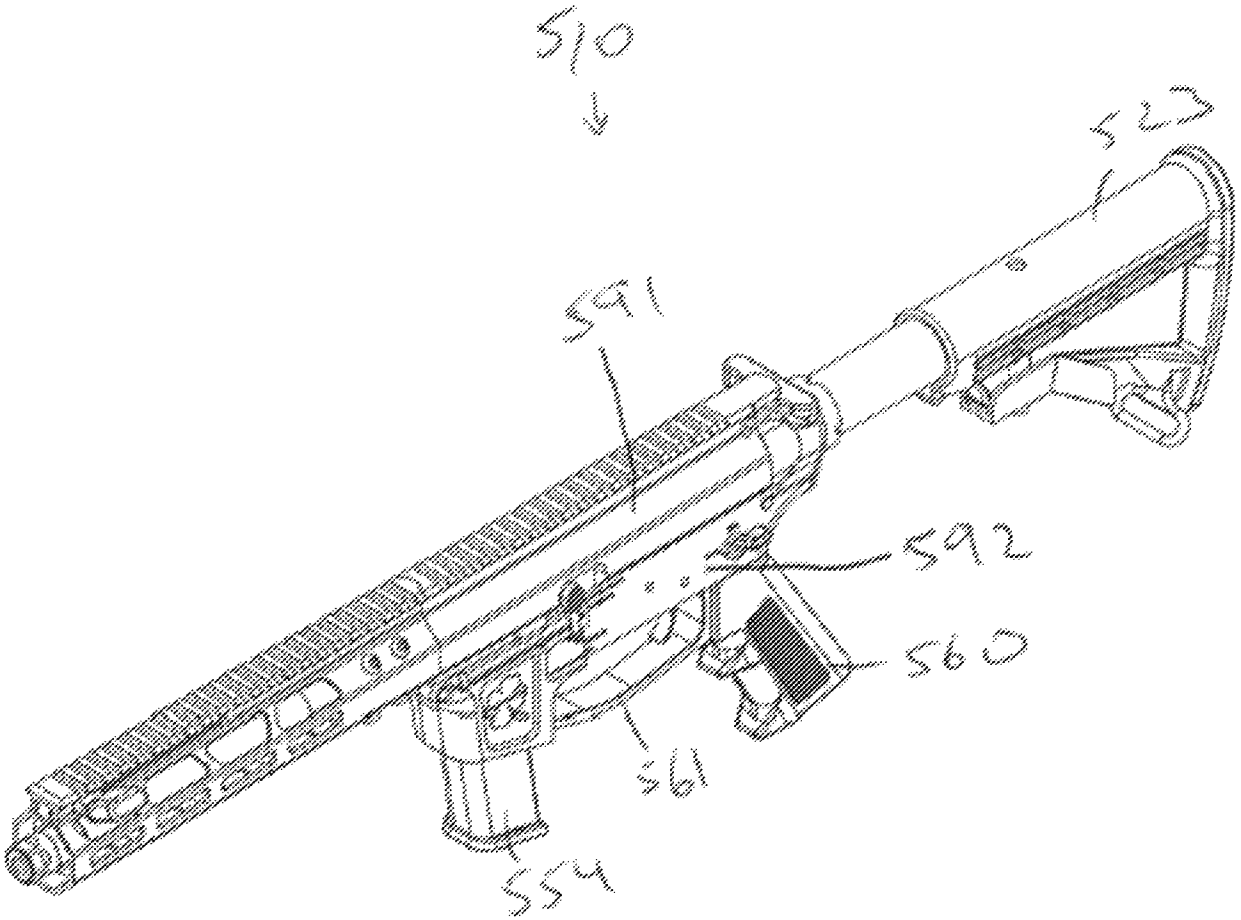
Figure 14:
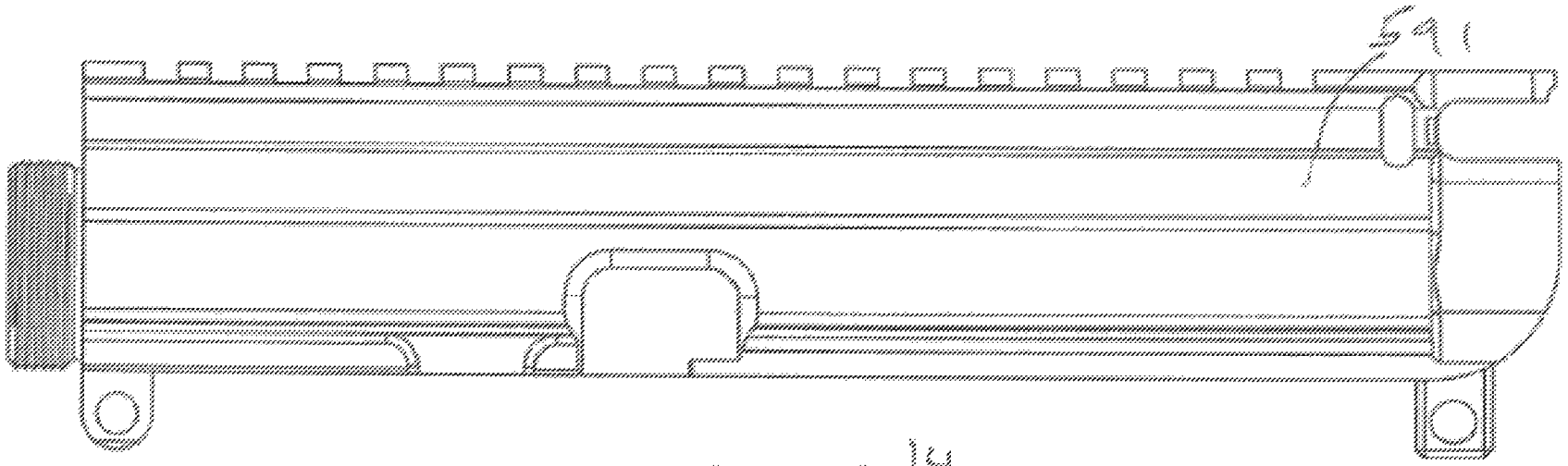
FIG. 14 depicts an upper receiver according to some embodiments presently disclosed.
Figure 15:
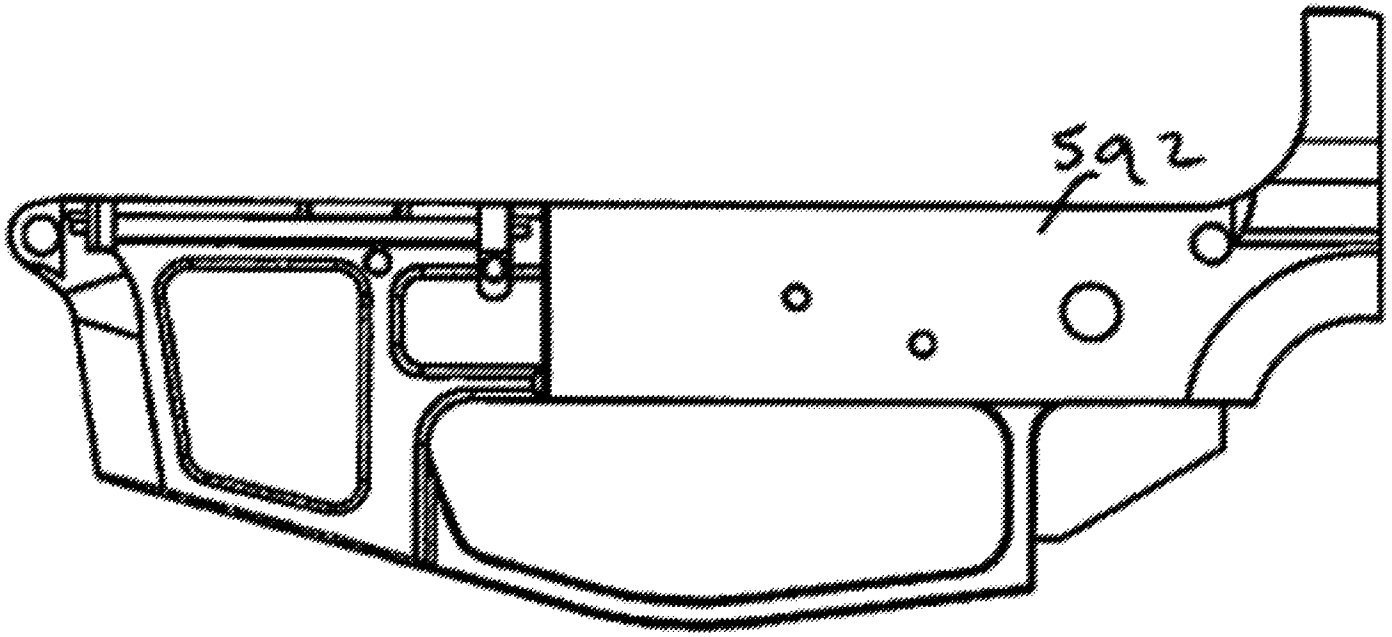
FIG. 15 depicts a lower receiver according to some embodiments presently disclosed.
Figure 16:
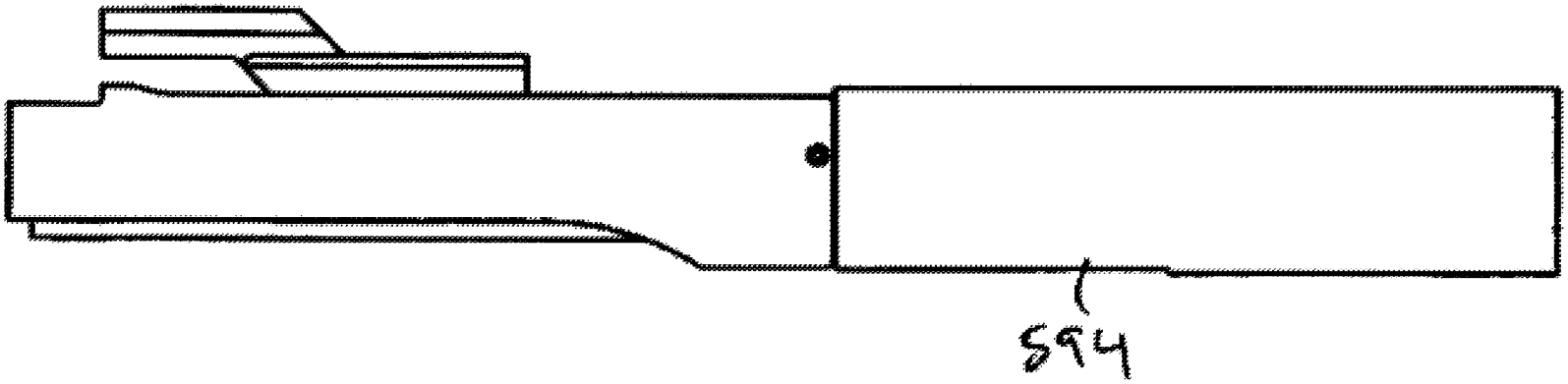
FIGS. 16-17 depict a bolt carrier group according to some embodiments presently disclosed.
Figure 17:
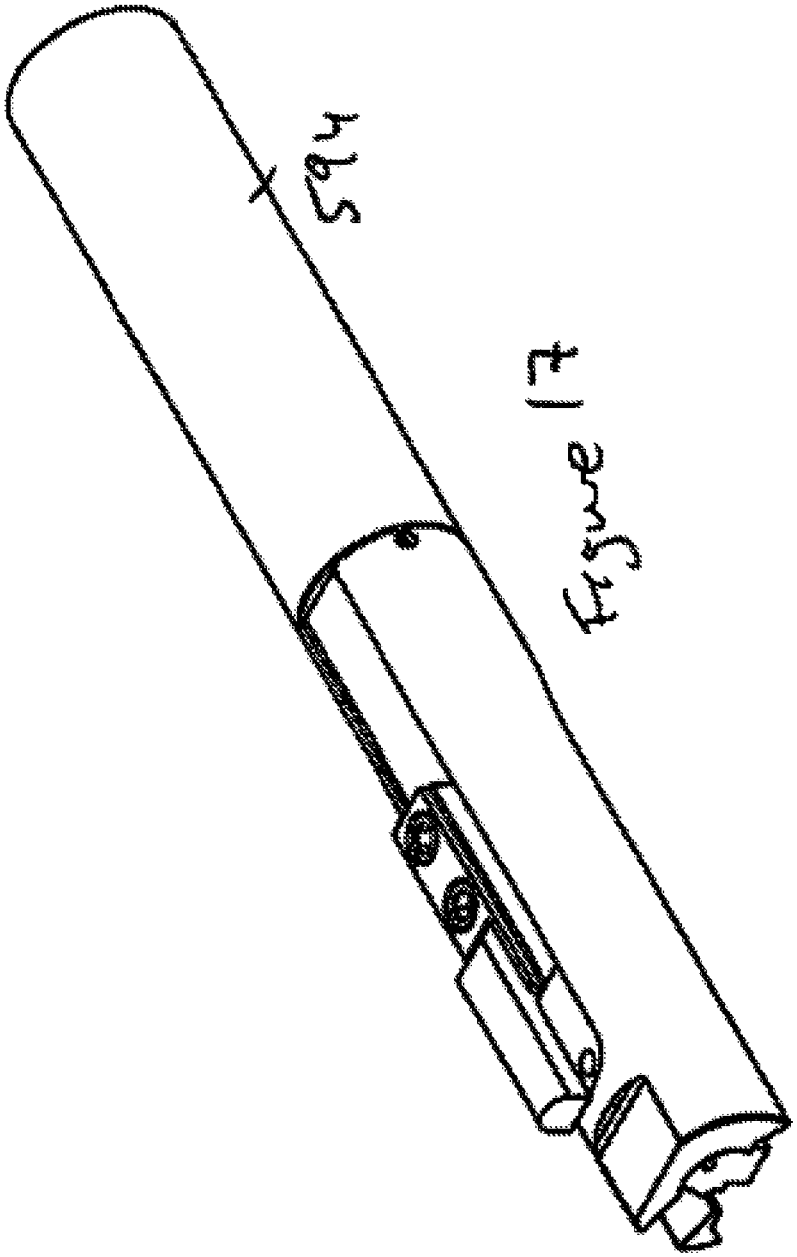
Figure 18:
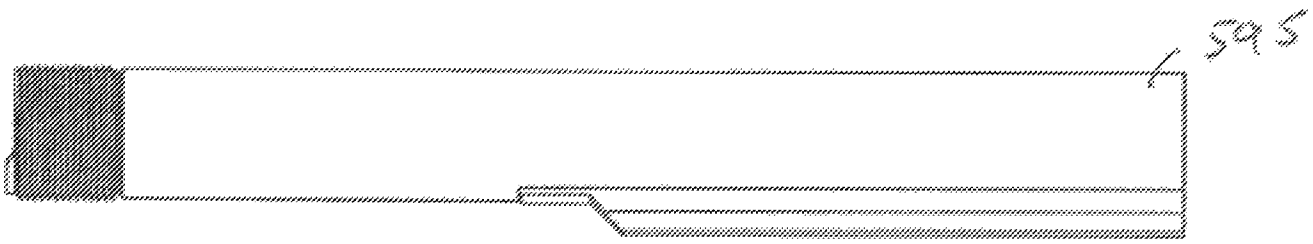
FIGS. 18-19 depict a buffer tube according to some embodiments presently disclosed.
Figure 19:
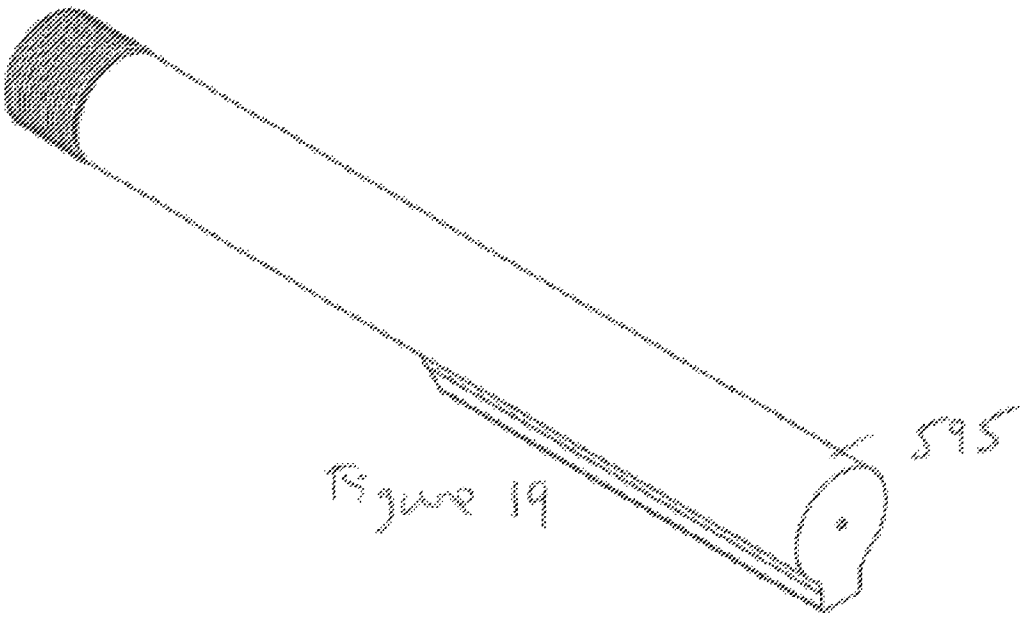
Figure 20:
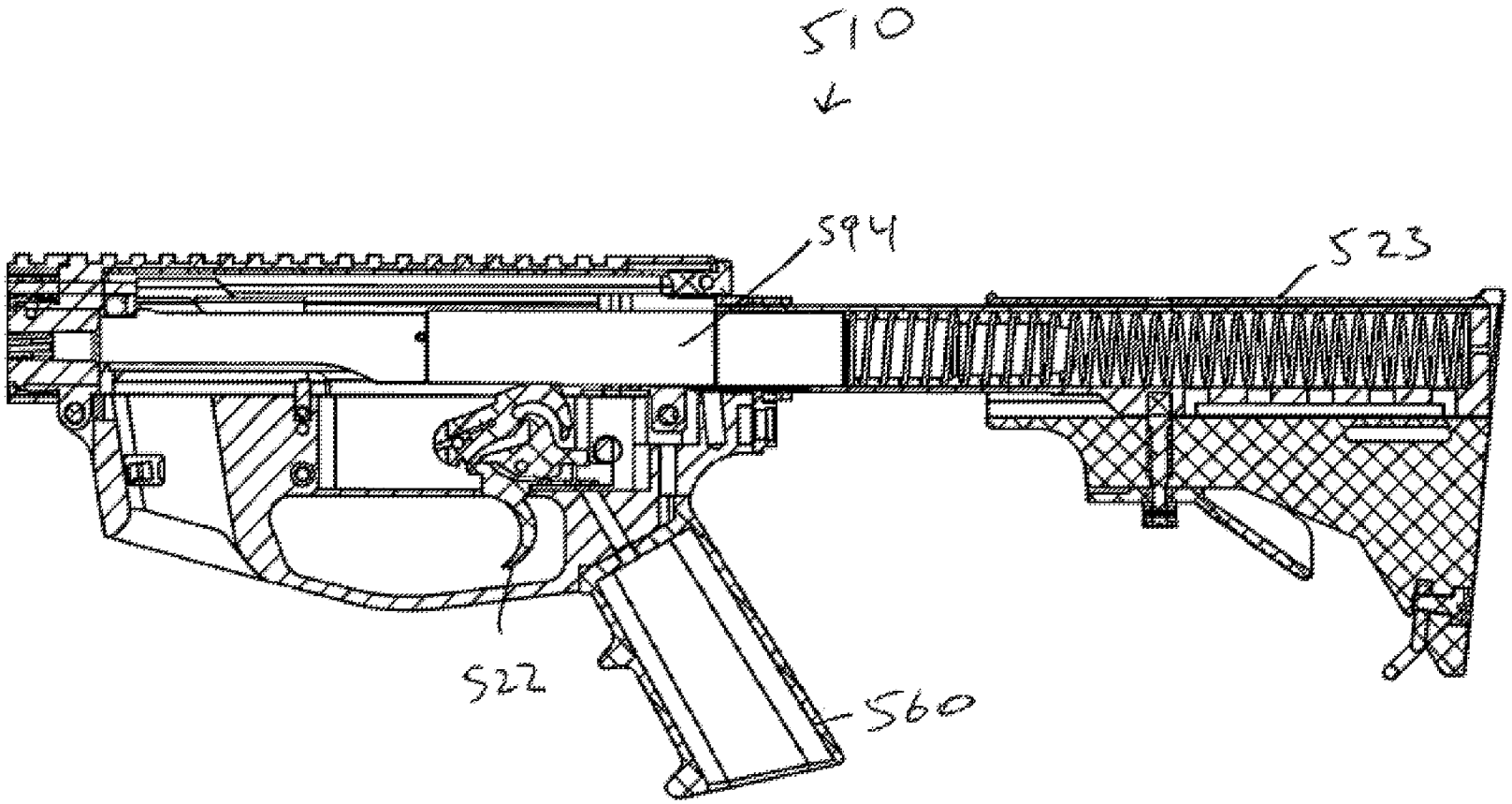
FIGS. 20-21 depict a cutaway view of a firearm according to some embodiments presently disclosed.
Figure 21:
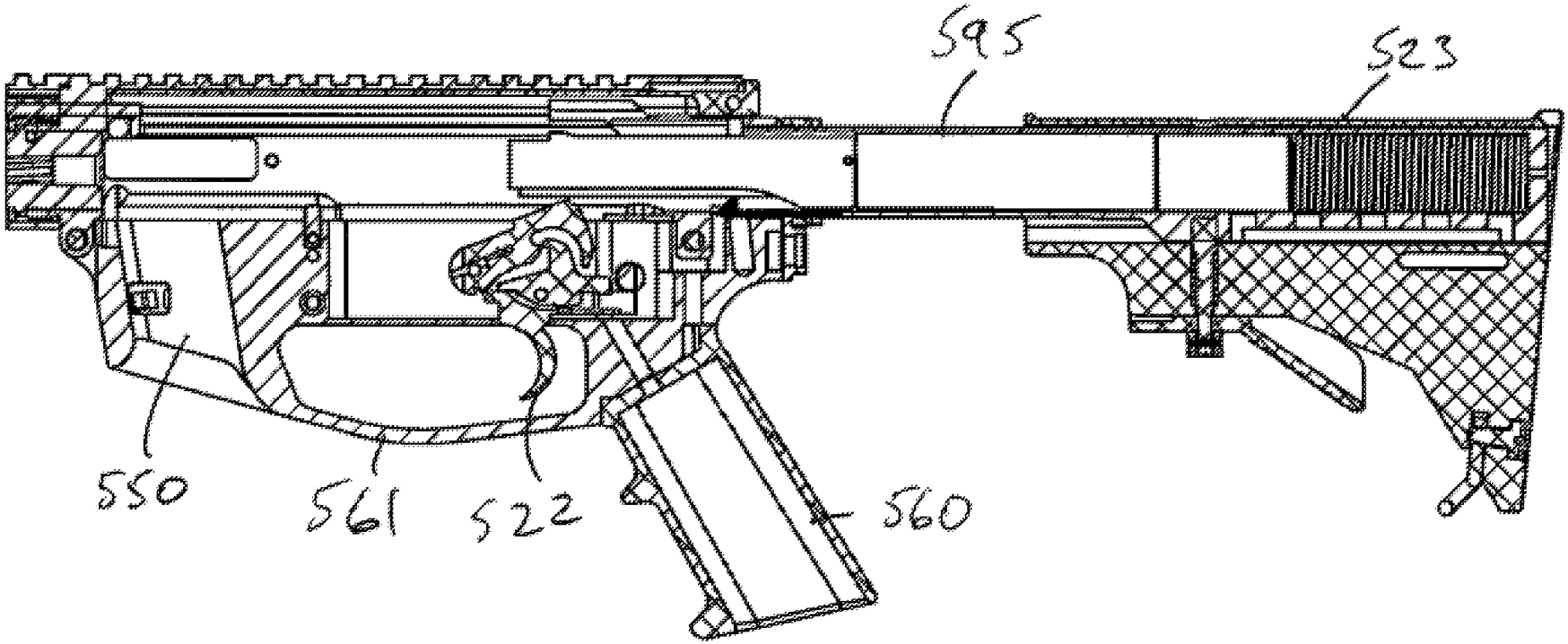

According to some embodiments, the frame 520 is contains an upper receiver 591 (shown in FIGS. 8-9 and 14) removably coupled with a lower receiver 592 (shown in FIGS. 8-9 and 15). According to some embodiments, the firearm 510 comprises a bolt carrier group 594 (shown in FIGS. 16-17 and 20-21). According to some embodiments presently disclosed, firearm 510 comprises the bolt carrier group 10 as described above. According to some embodiments presently disclosed, firearm 510 comprises the bolt carrier group 110 as described above.

According to some embodiments, the firearm 510 comprises a buffer tube 595 (shown in FIGS. 18-21). According to some embodiments, the firearm 510 comprises receiver extensions (i.e. buffer tubes) described in a U.S. Provisional Application No. 63/108,313, filed on Oct. 31, 2020, which is incorporated herein by reference in its entirety. According to some embodiments, the firearm 510 comprises receiver extensions (i.e. buffer tubes) described in a U.S. application Ser. No. 17/515,156, filed on Oct. 29, 2021, which is incorporated herein by reference in its entirety.

According to some embodiments presently disclosed, the firearm 510 is an AR type firearm.

According to some embodiments presently disclosed, the first material is steel, aluminum, metal, polymer, and/or sintered metal powder. According to some embodiments presently disclosed, the second material is steel, aluminum, metal, polymer, and/or sintered metal powder. According to some embodiments presently disclosed, the first melting point is lower than the second melting point.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A bolt carrier group comprising:

a first bolt carrier section comprising a first end and a second end;

a second bolt carrier section comprising a first end and a second end;

a plurality of pins positioned between the first bolt carrier section and the second bolt carrier section;

a coupling pin configured to prevent decoupling of the first bolt carrier section from the second bolt carrier section.

2. The bolt carrier group of claim 1, wherein the second end of the first bolt section comprises a plurality of apertures configured to accommodate the plurality of pins.

3. The bolt carrier group of claim 2, wherein the plurality of pins protrude from the first end of the second bolt carrier section.

4. The bolt carrier group of claim 1, wherein each pin comprises a notch, wherein the coupling pin is configured to engage the notch of each pin to prevent decoupling of the first bolt carrier section from the second bolt carrier section.

* * * * *